US008129608B2

(12) United States Patent
Lee

(10) Patent No.: US 8,129,608 B2
(45) Date of Patent: Mar. 6, 2012

(54) AUTOMATIC PLAYING AND RECORDING APPARATUS FOR ACOUSTIC/ELECTRIC GUITAR

(75) Inventor: Chang-Sun Lee, Seoul (KR)

(73) Assignee: KPBO Co., Ltd. (KR)

( * ) Notice: Subject to any disclaimer, the term of this patent is extended or adjusted under 35 U.S.C. 154(b) by 882 days.

(21) Appl. No.: 11/573,996

(22) PCT Filed: Dec. 30, 2004

(86) PCT No.: PCT/KR2004/003531

§ 371 (c)(1),
(2), (4) Date: Feb. 20, 2007

(87) PCT Pub. No.: WO2006/019212

PCT Pub. Date: Feb. 23, 2006

(65) Prior Publication Data

US 2008/0307949 A1 Dec. 18, 2008

(30) Foreign Application Priority Data

Aug. 17, 2004 (KR) ..... 10-2004-0064720

(51) Int. Cl.
*G10H 1/36* (2006.01)

(52) U.S. Cl. ..... 84/741; 84/610; 84/625; 84/634; 84/267

(58) Field of Classification Search ..... 84/741
See application file for complete search history.

(56) References Cited

U.S. PATENT DOCUMENTS 5,731,535 A * 3/1998 Hudak ..... 84/733
(Continued)

FOREIGN PATENT DOCUMENTS

EP 1 081 680 A1 3/2001
(Continued)

OTHER PUBLICATIONS

Office Action issued by the Chinese Patent Office on Jan. 8, 2010 in connection with corresponding Chinese Patent Application No. 200480043686.7.

(Continued)

*Primary Examiner* — Elvin G Enad
*Assistant Examiner* — Christopher Uhlir
(74) *Attorney, Agent, or Firm* — Ostrolenk Faber LLP

(57) ABSTRACT

Automatic playing and recording apparatuses for an acoustic/electric guitar allow a user to play in concert along with music of other musical instruments outputted by an automatic playing apparatus by adding the automatic playing apparatus to an acoustic/electric guitar, or to record/process user's guitar music or ensemble music and then reproduce/output the guitar music or the ensemble music according to user's need by adding a recording apparatus to an acoustic/electric guitar. The automatic playing and recording apparatuses for an acoustic/electric guitar comprise: a pre-amp for amplifying guitar music at a predetermined level, controlling the tone according to user's demand and then outputting the guitar music to a dedicated guitar amp; an automatic playing apparatus for storing an outer music file using the internal memory or converting an exterior music signal into a music file to thereby output the music file to the pre-amp; and a recording apparatus for storing an output of the pre-amp in the internal memory. Accordingly, the user can play in concert together with various musical instruments without adhering to time and place, and the user himself or herself can appreciate or listen to user's own guitar music or ensemble music with various musical instruments.

15 Claims, 1 Drawing Sheet

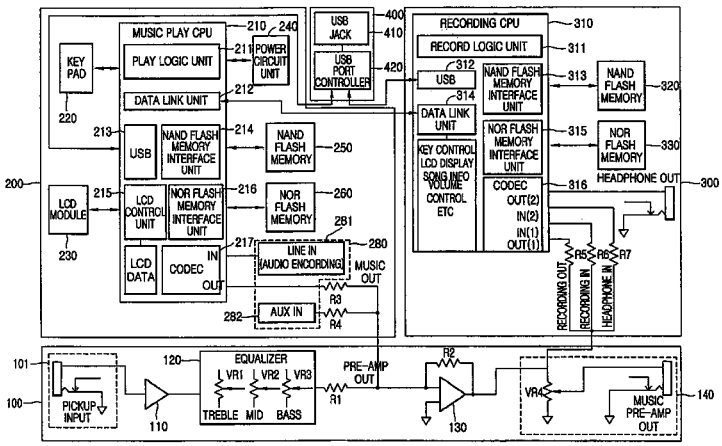

U.S. PATENT DOCUMENTS

| | | | | |
|---|---|---|---|---|
| 5,741,992 | A | 4/1998 | Nagata | |
| 5,744,744 | A * | 4/1998 | Wakuda | 84/650 |
| 5,837,912 | A * | 11/1998 | Eagen | 84/267 |
| 5,839,108 | A * | 11/1998 | Daberko et al. | 704/270 |
| 5,990,405 | A | 11/1999 | Auten et al. | 84/609 |
| 6,605,765 | B1 | 8/2003 | Johnson | |
| 2003/0159570 | A1 | 8/2003 | Toshitani | 84/645 |
| 2004/0138770 | A1 | 7/2004 | Hanabusa et al. | 700/94 |
| 2004/0144241 | A1 | 7/2004 | Juskiewicz et al. | 84/723 |

FOREIGN PATENT DOCUMENTS

| | | |
|---|---|---|
| JP | 02-137895 | 5/1990 |
| JP | 07-064541 | 3/1995 |
| JP | 07-239683 | 9/1995 |
| JP | 10-143156 | 5/1998 |
| JP | 11-305772 | 11/1999 |
| JP | 2004-220708 | 8/2004 |
| KR | 1983-0004509 | 5/1985 |
| KR | 1985-0001437 | 10/1985 |
| KR | 1993-0003352 | 2/1993 |
| KR | 221367 | 9/1999 |

OTHER PUBLICATIONS

Translation of Office Action issued by the Chinese Patent Office on Jan. 8, 2010 in connection with corresponding Chinese Patent Application No. 200480043686.7.

Office Action from Japanese Patent Office date Mar. 9, 2010 for corresponding case JP 2007-526968 (with English language translation).

* cited by examiner

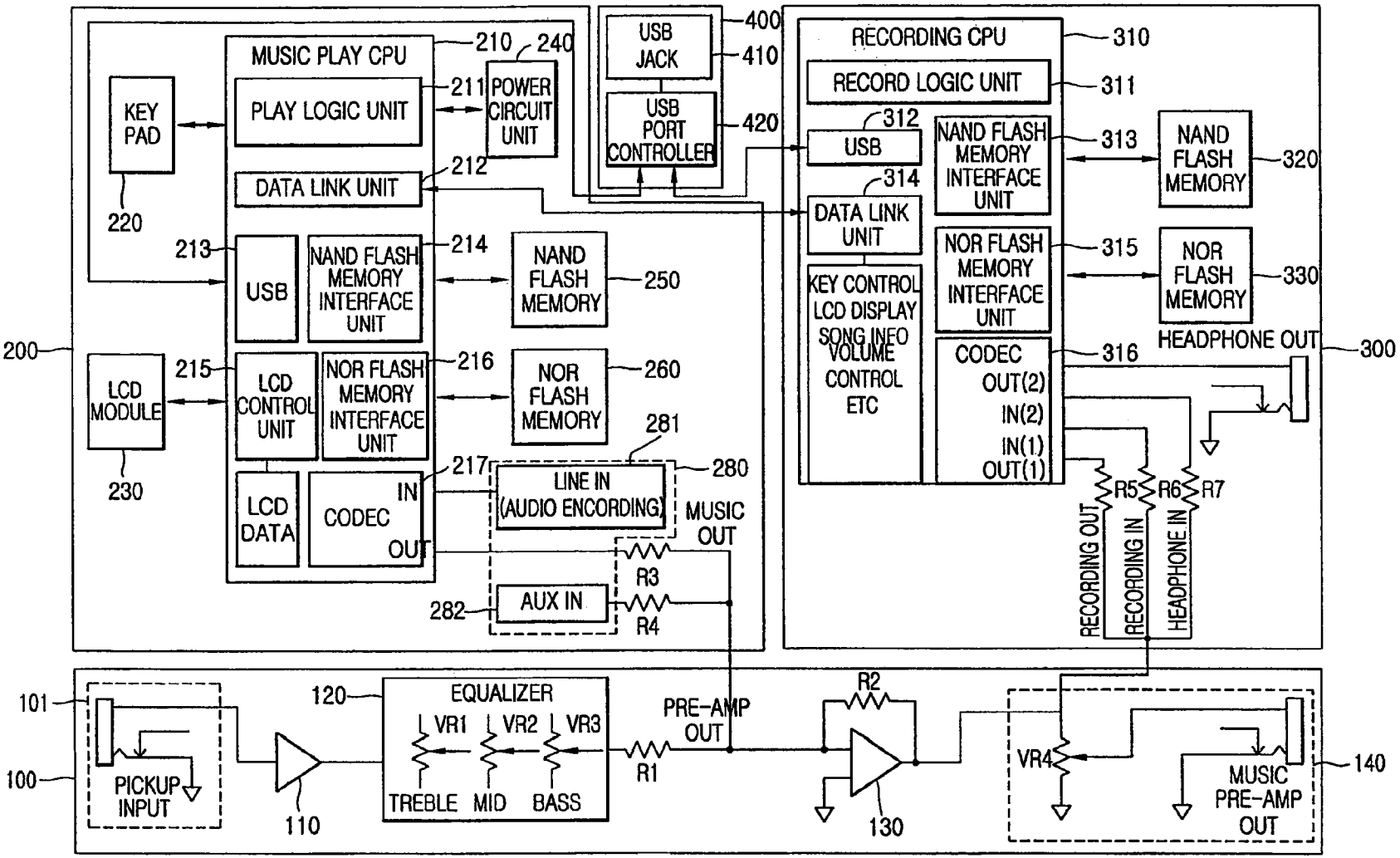
300
320
330
NAND FLASH MEMORY
NOR FLASH MEMORY
HEADPHONE OUT
R7
R6
R5
HEADPHONE IN
RECORDING IN
RECORDING OUT
310
311
313
315
316
RECORDING CPU
RECORD LOGIC UNIT
NAND FLASH MEMORY INTERFACE UNIT
NOR FLASH MEMORY INTERFACE UNIT
CODEC
OUT(2)
IN(2)
IN(1)
OUT(1)
312
314
USB
DATA LINK UNIT
KEY CONTROL
LCD DISPLAY
SONG INFO
VOLUME CONTROL
ETC
400
410
420
USB JACK
USB PORT CONTROLLER
250
260
280
281
MUSIC OUT
NAND FLASH MEMORY
NOR FLASH MEMORY
LINE IN (AUDIO ENCORDING)
R3
R4
AUX IN
240
POWER CIRCUIT UNIT
210
211
212
214
216
217
282
MUSIC PLAY CPU
PLAY LOGIC UNIT
DATA LINK UNIT
NAND FLASH MEMORY INTERFACE UNIT
NOR FLASH MEMORY INTERFACE UNIT
IN
CODEC
OUT
USB
LCD CONTROL UNIT
LCD DATA
213
215
KEY PAD
220
LCD MODULE
230
200
140
MUSIC PRE-AMP OUT
VR4
R2
130
PRE-AMP OUT
R1
EQUALIZER
VR1
VR2
VR3
TREBLE
MID
BASS
120
110
PICKUP INPUT
101
100

AUTOMATIC PLAYING AND RECORDING APPARATUS FOR ACOUSTIC/ELECTRIC GUITAR

TECHNICAL FIELD

The present invention relates to a technique for outputting music from a string instrument such as a guitar, and more particularly, to automatic playing and recording apparatuses for an acoustic/electric guitar which allow a user to reproduce user's own guitar music or play in concert with other music through an automatic playing apparatus, and to record user's music or ensemble music through a recording apparatus.

BACKGROUND ART

In general, an acoustic/electric guitar has a pre-amp mounted therein, and the pre-amp properly controls the tone of guitar music amplifies the guitar music at the proper level, and transmits the amplified guitar music to an external power amp.

However, since the conventional acoustic/electric guitar simply performs a typical pre-amp function only, there is a disadvantage that a user cannot be supplied with a variety of playing environments. That is, since the conventional acoustic/electric guitar cannot provide music of other musical instruments without being accompanied by performers of the other musical instruments, the conventional acoustic/electric guitar cannot allow performance environments with the other musical instruments. In addition, since a music storing function is not provided in the conventional acoustic/electric guitar, there is a disadvantage that the conventional acoustic/electric guitar is not a help to education for musical performance because the user cannot listen to user's own guitar music.

DISCLOSURE OF INVENTION

Technical Problem

Therefore, an object of the present invention is to allow a user to play in concert along with music of other musical instruments outputted by an automatic playing apparatus by adding the automatic playing apparatus to an acoustic/electric guitar.

Another object of the present invention is to record user's guitar music or ensemble music by adding a recording apparatus to an acoustic/electric guitar and thus to reproduce/output the guitar music or the ensemble music according to user's need.

Technical Solution

To achieve these and other advantages and in accordance with the purpose of the present invention, as embodied and broadly described herein, there is provided an automatic playing apparatus for an acoustic/electric guitar, comprising: a pre-amp for amplifying guitar music at a predetermined level, controlling the tone according to user's demand and then outputting the guitar music to a dedicated guitar amp; and an automatic playing apparatus for storing a plurality of pieces of music in a memory and reproducing a piece of music selected by the user to thereby output a selected piece of music to the pre-amp.

To achieve these and other advantages and in accordance with the purpose of the present invention, as embodied and broadly described herein, there is provided an automatic playing apparatus for an acoustic/electric guitar, comprising: a recording apparatus for an acoustic/electric guitar, comprising: a pre-amp for amplifying guitar music at a predetermined level, controlling the tone according to user's demand and then outputting the guitar music to a dedicated guitar amp; and a recording apparatus for recording the guitar music outputted from the pre-amp in a memory and reproducing to output the corresponding piece of music according to user's demand.

To achieve these and other advantages and in accordance with the purpose of the present invention, as embodied and broadly described herein, there are provided automatic playing and recording apparatuses for an acoustic/electric guitar, comprising: a pre-amp for amplifying guitar music at a predetermined level, controlling the tone according to user's demand and then outputting the guitar music to a dedicated guitar amp; an automatic playing apparatus for storing an outer music file using the internal memory or converting an exterior music signal into a music file to thereby output the music file to the pre-amp; and a recording apparatus for storing an output of the pre-amp in the internal memory.

The foregoing and other objects, features, aspects and advantages of the present invention will become more apparent from the following detailed description of the present invention when taken in conjunction with the accompanying drawings.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a block diagram showing automatic playing and recording apparatuses for an acoustic/electric guitar in accordance with the present invention.

BEST MODE

Reference will now be made in detail to the preferred embodiments of the present invention, examples of which are illustrated in the accompanying drawings.

A preferred embodiment of automatic playing and recording apparatuses for an acoustic/electric guitar which allow a user to record or reproduce music performed by the user and play in concert by the user himself or herself by recording music of other performer or by downloading music from a PC or audio equipment will be described in detail with reference to the accompanying drawings.

FIG. 1 is a block diagram showing automatic playing and recording apparatuses for an acoustic/electric guitar.

As shown in FIG. 1, the automatic playing and recording apparatuses for a guitar in accordance with the present invention includes: a pre-amp 100 amplifying user's guitar music at a predetermined level, controlling the tone according to the user's demands, mixing the user's guitar music with music of other musical instruments inputted from an automatic playing apparatus 200 to be described later to output the mixed music to a dedicated guitar amp (for example, a power amp), and receiving music reproduced/outputted from a recording apparatus 300 to be described later to output the reproduced/outputted music to the dedicated guitar amp; an automatic playing apparatus 200 for storing a plurality of pieces of music played on various musical instruments in a memory and reproducing a piece of music selected by the user to thereby output the piece of music to the pre-amp 100; a recording apparatus 300 for storing ensemble music of the guitar music outputted from the pre-amp 100 and the music outputted from the automatic playing apparatus 200 in a memory and reproducing the corresponding music according to user's demand; and a port controller 400 for receiving a program for upgrading the automatic playing apparatus or the recording apparatus, or music files from a computer.

A construction of the present invention will be described as follows.

Firstly, the pre-amp 100 includes: a pickup input unit 101 for pickup of the vibrations of strings generated by user's playing a guitar and outputting the vibrations as electric signals; a head amp 110 for amplifying an output signal of the pickup input unit 101 at a predetermined level; an equalizer 120 for appropriately emphasizing the band of treble, mid and base with respect to the guitar music outputted through the head amp 110 according to user's demand and outputting the guitar music as the corresponding tone; an audio mixer 130 for mixing the guitar music outputted from the equalizer 120 with the music of the various musical instruments provided from the automatic playing apparatus 200 to thereby output an audio signal; and a pre-amp output unit 140 for controlling the output signal mixed from the audio mixer 130 and the music inputted from the recording apparatus 300 by variable resistance (VR4) and outputting the controlled signal and music to the dedicated guitar amp.

Accordingly, the pre-amp 100 can mix the guitar music with the music of the various musical instruments provided from the automatic playing apparatus 200 and output the mixed music as a form of ensemble music or can receive the music provided from the recording apparatus 300 and output the music to the dedicated guitar amp. At this time, the following construction can be allowed: when the music (recording output signal) is supplied from the recording apparatus 300, the operation of the automatic playing apparatus 200 is stopped.

Meanwhile, the automatic playing apparatus 200 includes: a music play CPU 210 for performing all kinds of control functions for storing a plurality of pieces of music played on a variety of musical instruments in a memory and reproducing a piece of music selected by the user to thereby output a selected piece of music; a key pad 220 for inputting user's control command for automatic playing and recording; an LCD module 230 for displaying the operational status of the system or information for the user; a power circuit unit 240 for supplying the power to each part of the system; a NAND flash memory 250 for storing files on a plurality of pieces of music; a NOR flash memory 260 for executing a program for reproducing pieces of music; and an auxiliary input unit 280 including a line in 281 and an aux in 282 for receiving an audio signal from external equipment.

Here, the music play CPU 210 includes: an USB (universal serial bus) for transmitting a music file or performing a software upgrade; a data link unit 212 for performing data communications between the music play CPU 210 of the automatic playing apparatus 200 and a recording CPU 310 of the recording apparatus 300 and allowing the automatic playing apparatus 200 and the recording apparatus 300 to exchange data of music information stored in the recording apparatus 300, control information of the key pad 220, control information of an LCD control unit 215 through the LCD module 230 and volume control; a codec 217 for converting a digital bit stream of the corresponding music file stored in the NAND flash memory 250 into an analog signal and outputting the analog signal, outputting the music file to the pre-amp 100, or receiving an external audio signal and converting the external audio signal into a music file; various interfaces 214 and 216 for connections with all kinds of memories inside the automatic playing apparatus 200; and a play logic unit 211.

Accordingly, the automatic playing apparatus 200 can store the outer music file using the internal memory or convert the exterior music signal into a music file to thereby output the music file to the pre-amp.

Meanwhile, the recording apparatus 300 includes: a recording CPU 30 for performing all kinds of control functions for storing the guitar music outputted from the pre-amp 100 and various ensemble music, and reproducing the corresponding music according to user's demand; a NAND flash memory 320 for storing files of the guitar music and the various ensemble music; and a NOR flash memory 330 for storing a program for recording and reproducing the files of the guitar music outputted from the pre-amp 100 and ensemble music.

Here, the recording CPU 310 includes: an USB (Universal Serial BUS) 312 for transmitting a music file or performing a software upgrade; a data link unit 314 for performing data communications between the CPUs of the automatic playing apparatus and the recording apparatus; a codec 316 for converting a signal inputted/outputted from/to the pre-amp 100 into a digital signal or an analog signal, converting a signal to be outputted to an external headphone, or converting a signal inputted/outputted from/to the pre-amp 100; various interfaces 313 and 315 for connections with various memories inside the recording apparatus 300; and a record logic unit 311.

Lastly, the port controller 400 is a BUS path for receiving a music file or upgrading a program, and includes a USB port controller 420 and a USB jack 410.

The operation of the present invention having such a construction will be described in detail.

Firstly, a process of outputting music of an acoustic/electric guitar through the pre-amp 100 will be described.

When the user plays the guitar, the pickup input unit 101 pickups the vibrations of the strings regarding the guitar music and converts the vibrations into electric signals. After the inputted guitar music is amplified at a predetermined level through the head amp 110, treble (10 KHz), middle (1 KHz) and bass (100 Hz) of the guitar music are appropriately emphasized by user's adjusting variable resistance (VR1), (VR2) and (VR3) and is converted into the corresponding tune. And, the above-processed guitar music passes through the audio mixer 130, is controlled at a predetermined level by the variable resistance (VR4), and then is outputted to the dedicated guitar amp through a music pre-amp out.

Meanwhile, when the user plays the guitar, the user can play in concert by outputting music of the other musical instruments through the automatic playing apparatus 200. A process of outputting the ensemble music will be described as follows.

If the user presses a play key through the key pad 220 of the automatic playing apparatus 200, the music play CPU 210 recognizes it. After a text message, 'PLAY MODE', is displayed on the LCD module 230 for a while, titles of pieces of music stored in the NAND flash memory 250 are read through and displayed on the LCD module 230. At this time, the program for automatic playing stored in the NOR flash memory 260 is in a state of standby. In such a state, if the user presses a play key after selecting a title of a piece of music to be played through a lever switch (not shown), a digital bit stream of the corresponding music file stored in the NAND flash memory 250 is converted into its original analog signal through the codec 217 by the all of the music play CPU 210.

The converted analog signal is appropriately adjusted in effect, equalizer and volume by the play logic unit 211, and then the analog signal is outputted to the pre-amp 100. The automatic playing output signal outputted from the automatic playing apparatus 200 is mixed with the guitar music signal in the audio mixer 130 of the pre-amp 100. At this time, the gain of the guitar music outputted from the equalizer 120 is determined by values of resistance R1 and R2, and the gain of the automatic playing output signal outputted from the automatic playing apparatus 200 is determined by values of resistance (R2) and (R3).

Meanwhile, an audio signal inputted from the exterior equipment through the auxiliary input unit 280 is mixed with the playing signals in the audio mixer 130. The gain of the audio signal inputted from the exterior equipment is determined by values of resistance (R4) and (R2).

The signal of the mixed ensemble music is adjusted by variable resistance (VR4) at a certain level and then is outputted to the dedicated guitar amp of the outside. Accordingly, when the user plays the guitar, the user can play in concert along with music of other musical instruments reproduced/outputted from the NAND flash memory 250 or the music inputted through the auxiliary input unit 280 after being reproduced in the exterior equipment such as a CD player or an MP3 player.

Meanwhile, the guitar music or the ensemble music outputted through such processes is stored in the recording apparatus 300 and can be reproduced and appreciated according to user's need, which will be described as follows.

When the user presses the play key, the music play CPU 210 recognizes this to thereby inform the recording CPU 310 of this fact through the data link units 212 and 312 and display a text message, 'REC MODE', on the LCD module 230. According to this, the recording CPU 310 reads a list of pieces of music stored in the NAND flash memory 320, and the list is transmitted to the music play CPU 210 through the data link units 212 and 312. Accordingly, the list is displayed on the LCD module 230 by the music play CPU 210. At this time, the recording program stored in the NOR flash memory 330 is in a state of standby.

In such a state, if the user presses the play key again, a text message, 'RECORDING', is displayed on the LCD module 230, and the system is changed into a recording mode.

Accordingly, signals of user's own guitar music outputted through the audio mixer 130 of the pre-amp 100, ensemble music of user's own guitar music and music reproduced from the automatic playing apparatus 200, ensemble music of user's own guitar music and music inputted through the aux in, ensemble music of user's own guitar music the music reproduced/outputted from the automatic playing apparatus 200 and the music inputted through the aux in are converted into digital signals through the codec 316 of the reproducing CPU 310, and then the digital signals are stored in the NAND flash memory 320.

The music play CPU 210 receives and processes information on music recorded in the NAND flash memory 320, and information on display, volume control and key control from the recording CPU 310 through the data link units 212 and 312. If the user presses the stop key on the key pad 230, a recorded music file is generated and listed up. And, if the user selects a random file to be played among music files having been recorded so far by using the lever switch and presses the play key, a digital bit stream of the corresponding music file stored in the NAND flash memory 320 is converted into the original analog signal through the codec 316. Also, after appropriately being adjusted in effect, equalizer and volume by the record logic unit 311, the converted analog signal, on the one hand, is outputted to the headphone out and on the other is outputted to the music pre-amp out 140 after being adjusted at a certain level by the variable resistance (VR4). Accordingly, after recording ensemble music of user's own guitar music and various music through the processes, the user can select a desired music part and listen to it again. When the dedicated guitar amp is not provided, the desired music can be played by connecting the headphone to the headphone out.

Meanwhile, the port controller is installed to upgrade software of the music play CPU 210 and the recording CPU or receive music files from the computer. Accordingly, the user can upgrade a desired CPU by selecting the CPU to be upgraded from the two CPUs 210 and 310 on the menu and then executing the corresponding upgrade program.

With reference to FIG. 1, a construction that the pre-amp 100, the automatic playing apparatus 200 and the rewording apparatus 300 are all coupled is described as an example. However, in case the present invention is implemented by coupling the pre-amp 100 and the automatic playing apparatus 200 or the pre-amp 100 and the recording apparatus 300, the corresponding functions of each part are performed by identical principles.

Industrial Applicability

As so far described, the present invention allows a user to play in concert with music of other musical instruments outputted by an automatic playing apparatus by adding the automatic playing apparatus to an acoustic/electric guitar. Accordingly, the user can play in concert together with various musical instruments without adhering to time and place.

In addition, by adding a recording apparatus to the acoustic/electric guitar, user's music or ensemble music is recorded/processed and then is reproduced/outputted Wording to user's need. Accordingly, the user himself or herself can appreciate or listen to user's own guitar music or ensemble music with various musical instruments.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. An acoustic/electric guitar that processes guitar sound signals together with pre-stored sound signals, the guitar comprising:

a pre-amp for amplifying guitar sound signals at a predetermined level, controlling a tone according to user's demand and then outputting the sound signals to a dedicated guitar amp;

an automatic playing unit comprising:

a circuit configured to convert a music signal from an external source into at least one outer music file;

a NAND flash memory for storing the at least one music file other than the guitar sound signals;

a NOR flash memory for storing a program for reproducing the at least one outer music file;

wherein the automatic playing unit is configured to play at least one outer music file stored in the NAND flash memory and to output the played at least one outer music file to the pre-amp; and a recording unit comprising an internal memory for storing an output of the pre-amp, wherein the pre-amp is configured to mix the guitar sound signals with electric signals of the played at least one outer music file provided from the automatic playing unit to thereby output the mixed signals as an ensemble of sound signals, and to receive signals provided from the recording unit to thereby output the ensemble of sound signals provided from the recording unit to the dedicated guitar amp; and wherein the pre-amp comprises:

a pickup input unit for pickup of vibrations of guitar strings and outputting the vibrations as electric signals;

a head amp for amplifying output signals of the pickup input unit at a predetermined level;

an equalizer for emphasizing the guitar sound signals outputted from the head amp in treble, mid and bass, respectively, and outputting the guitar sound signals by a corresponding timbre;

an audio mixer for mixing the guitar sound signals outputted from the equalizer with electric signals of various musical instruments provided from the automatic playing unit; and a pre-amp output unit for outputting output signals mixed from the audio mixer and sound signals by controlling the signals provided from the recording unit to the dedicated guitar amp.

2. The acoustic/electric guitar of claim 1, wherein the pre-amp stops the output operation of the automatic playing unit if the signals provided from the recording unit are received.

3. The acoustic/electric guitar of claim 1, wherein the pre-amp output unit includes variable resistance for controlling the signals provided from the audio mixer or the recording unit.

4. The acoustic/electric guitar of claim 1, wherein the signals outputted from the pre-amp are guitar sound signals played by the user;

ensemble sound signals of user's guitar sound signals and music reproduced from the automatic playing unit; ensemble sound signals of user's guitar sound signals and music inputted through an external auxiliary input unit; or ensemble sound signals of user's guitar sound signals, the music reproduced/outputted from the automatic playing unit and the music inputted through the aux in.

5. The acoustic/electric guitar of claim 1, wherein the automatic playing unit further comprises:

a key pad for receiving a user's control command for automatic playing and recording;

an LCD module for displaying operational status of the system or user information;

an auxiliary input unit for receiving audio signals from external equipment; and a power circuit unit for supplying power to each component of the guitar.

6. The acoustic/electric guitar of claim 1, wherein the processor comprises:

an USB interface for transmitting a music file or performing a software upgrade;

a codec for outputting the music file to the pre-amp, or receiving the external audio signals and converting the external audio signals into a music file; and a data link unit for performing data communications between the CPU of the automatic playing unit and a CPU of the recording unit.

7. The acoustic/electric guitar of claim 6, wherein the data link unit exchanges data of music information stored in the recording unit, control information of a key pad, control information of an LCD control unit through a LCD module and volume control with the recording unit.

8. The acoustic/electric guitar of claim 1, wherein the recording unit comprises:

a CPU for performing control functions for storing files of the guitar sound signals outputted from the pre-amp and various ensemble sound signals in the internal memory and reproducing the corresponding music according to user's demand;

said NAND flash memory being configured for storing files of the guitar sound signals and various ensemble sound signals; and said NOR flash memory being configured for executing a program for recording and reproducing music.

9. The acoustic/electric guitar of claim 8, wherein the CPU comprises:

an USB interface for transmitting a music file or performing a software upgrade;

a data link unit for performing data communications between a CPU of the automatic playing unit and the CPU of the recording unit; and a codec for converting a signal inputted/outputted from/to the pre-amp into a digital signal or an analog signal.

10. The acoustic/electric guitar of claim 9, wherein the codec converts a signal to be outputted to an external headphone or a signal inputted/outputted from/to the pre-amp.

11. The acoustic/electric guitar of claim 1, further comprising:

a port controller for receiving a program for upgrading the automatic playing unit or the recording unit or music files from a computer.

12. The acoustic/electric guitar of claim 1, wherein the automatic playing unit converts external sound signals into a music file to thereby output the converted music file to the pre-amp.

13. The acoustic/electric guitar of claim 1, wherein the recording unit stores the guitar sound signals outputted from the pre-amp or ensemble sound signals with a variety of musical instrument sound signals stored in the internal memory and reproduces the stored sound signals.

14. An acoustic/electric guitar comprising:

a pre-amp unit comprising:

a pickup unit that receives guitar sounds played by a user;

an audio mixer that receives the guitar sounds from the pickup unit and provides output music signals forming ensemble music sounds;

a circuit configured to convert a music signal from an external source into at least one outer music file;

an automatic playing unit comprising:

a NAND flash memory for storing the at least one outer music file other than guitar sound signals;

a NOR flash memory for storing a program for reproducing the at least one outer music file; and a processor that provides control to output signals of at least one outer music file selected from the at least one stored outer music file to the audio mixer in the pre-amp unit to form the ensemble music sounds; and a recording unit comprising:

a memory that stores the ensemble music sounds from the pre-amp unit; and a processor that provides control to output the stored ensemble music sounds via a sound output device, wherein the automatic playing unit is housed within the acoustic/electric guitar by being operatively connected via wired connections with the pre-amp unit and the recording unit, wherein the automatic playing unit is configured to play at least one outer music file stored in the NAND flash memory, and to output the played at least one outer music file to the pre-amp, and wherein the automatic playing unit includes a data link unit and the recording unit includes a data link unit that cooperate together under respective control of the processor in the automatic playing unit and the processor in the recording unit, such that the user is informed about a recording state of the recording unit; and wherein the pre-amp unit comprises:

the pickup input unit configured to pickup vibrations of guitar strings and output the vibrations as electric signals;

a head amp for amplifying output signals of the pickup input unit at a predetermined level;

an equalizer for emphasizing the guitar sound signals outputted from the head amp in treble, mid and bass, respectively, and outputting the guitar sound signals by a corresponding timbre;

said audio mixer being configured to mix the guitar sound signals outputted from the equalizer with electric signals of various musical instruments provided from the automatic playing unit; and a pre-amp output unit for outputting output signals mixed from the audio mixer and sound signals by controlling signals provided from the recording unit to a dedicated guitar amp.

15. The guitar of claim 14, further comprising:

a display screen that provides visual outputs to the user to inform about the recording state based on the cooperation between the data link units.

* * * * *